US009729974B2

(12) United States Patent
van Halteren et al.

(10) Patent No.: US 9,729,974 B2
(45) Date of Patent: Aug. 8, 2017

(54) HYBRID RECEIVER MODULE

(71) Applicant: Sonion Nederland B.V., Hoofddorp (NL)

(72) Inventors: Aart Zeger van Halteren, Woudenberg (NL); Morten Kjeldsen Andersen, Odder (DK); Caspar Titus Bolsman, Amsterdam (NL); Rasmus Voss, The Hague (NL)

(73) Assignee: Sonion Nederland B.V., Hoofddorp (NL)

( * ) Notice: Subject to any disclaimer, the term of this patent is extended or adjusted under 35 U.S.C. 154(b) by 0 days.

(21) Appl. No.: 14/976,970

(22) Filed: Dec. 21, 2015

(65) Prior Publication Data

US 2016/0192087 A1 Jun. 30, 2016

(30) Foreign Application Priority Data

Dec. 30, 2014 (EP) ..... 14200604

(51) Int. Cl.

| | |
|---|---|
| ***H04R 11/02*** | (2006.01) |
| ***H04R 23/02*** | (2006.01) |
| ***H04R 9/02*** | (2006.01) |
| ***H04R 9/08*** | (2006.01) |
| ***H04R 11/04*** | (2006.01) |
| ***H04R 1/24*** | (2006.01) |
| ***H04R 7/12*** | (2006.01) |
| ***H04R 7/18*** | (2006.01) |
| ***H04R 13/00*** | (2006.01) |

(52) U.S. Cl.

CPC ..... *H04R 23/02* (2013.01); *H04R 1/24* (2013.01); *H04R 7/122* (2013.01); *H04R 7/18* (2013.01); *H04R 9/025* (2013.01); *H04R 9/08* (2013.01); *H04R 11/02* (2013.01); *H04R 11/04* (2013.01); *H04R 13/00* (2013.01); *H04R 2499/11* (2013.01)

(58) Field of Classification Search

CPC ..... H04R 23/02; H04R 7/122; H04R 1/24; H04R 13/00; H04R 11/02; H04R 9/08; H04R 9/025; H04R 11/04; H04R 2499/11

USPC ..... 381/398

See application file for complete search history.

(56) References Cited

U.S. PATENT DOCUMENTS

| | | | |
|---|---|---|---|
| 6,788,796 | B1 | 9/2004 | Miles et al. |
| 6,831,577 | B1 | 12/2004 | Furst |
| 6,853,290 | B2 | 2/2005 | Jorgensen et al. |
| 6,859,542 | B2 | 2/2005 | Johannsen et al. |

(Continued)

FOREIGN PATENT DOCUMENTS

| | | | |
|---|---|---|---|
| DE | 102009004496 | A1 | 7/2010 |
| EP | 1194002 | A2 | 4/2002 |

(Continued)

OTHER PUBLICATIONS

Partial European Search Report for Application No. EP 15201604.4, mailed May 25, 2016 (8 pages).

(Continued)

*Primary Examiner* — Brian Ensey

(74) *Attorney, Agent, or Firm* — Nixon Peabody LLP

(57) ABSTRACT

The present invention relates to a compact and robust hybrid receiver comprising a moving coil type receiver and one or more moving armature type receivers, wherein the moving coil type receiver and the moving armature type receiver, at least partly, share a common magnetic circuit.

21 Claims, 11 Drawing Sheets

(56) References Cited

U.S. PATENT DOCUMENTS

| | | | |
|---|---|---|---|
| 6,888,408 | B2 | 5/2005 | Furst et al. |
| 6,914,992 | B1 | 7/2005 | van Halteren et al. |
| 6,919,519 | B2 | 7/2005 | Ravnkilde et al. |
| 6,930,259 | B1 | 8/2005 | Jorgensen et al. |
| 6,943,308 | B2 | 9/2005 | Ravnkilde et al. |
| 6,974,921 | B2 | 12/2005 | Jorgensen et al. |
| 7,008,271 | B2 | 3/2006 | Jorgensen |
| 7,012,200 | B2 | 3/2006 | Moller |
| 7,062,058 | B2 | 6/2006 | Steeman et al. |
| 7,062,063 | B2 | 6/2006 | Hansen et al. |
| 7,072,482 | B2 | 7/2006 | Van Doorn et al. |
| 7,088,839 | B2 | 8/2006 | Geschiere et al. |
| 7,110,560 | B2 | 9/2006 | Stenberg |
| 7,136,496 | B2 | 11/2006 | van Halteren et al. |
| 7,142,682 | B2 | 11/2006 | Mullenborn et al. |
| 7,181,035 | B2 | 2/2007 | van Halteren et al. |
| 7,190,803 | B2 | 3/2007 | van Halteren |
| 7,206,428 | B2 | 4/2007 | Geschiere et al. |
| 7,221,767 | B2 | 5/2007 | Mullenborn et al. |
| 7,221,769 | B1 | 5/2007 | Jorgensen |
| 7,227,968 | B2 | 6/2007 | van Heltren et al. |
| 7,239,714 | B2 | 7/2007 | de Blok et al. |
| 7,245,734 | B2 | 7/2007 | Niederdraenk |
| 7,254,248 | B2 | 8/2007 | Johannsen et al. |
| 7,286,680 | B2 | 10/2007 | Steeman et al. |
| 7,292,700 | B1 | 11/2007 | Engbert et al. |
| 7,292,876 | B2 | 11/2007 | Bosh et al. |
| 7,336,794 | B2 | 2/2008 | Furst et al. |
| 7,376,240 | B2 | 5/2008 | Hansen et al. |
| 7,403,630 | B2 | 7/2008 | Jorgensen et al. |
| 7,415,121 | B2 | 8/2008 | Mögelin et al. |
| 7,425,196 | B2 | 9/2008 | Jorgensen et al. |
| 7,460,681 | B2 | 12/2008 | Geschiere et al. |
| 7,466,835 | B2 | 12/2008 | Stenberg et al. |
| 7,492,919 | B2 | 2/2009 | Engbert et al. |
| 7,548,626 | B2 | 6/2009 | Stenberg et al. |
| 7,657,048 | B2 | 2/2010 | van Halteren et al. |
| 7,684,575 | B2 | 3/2010 | van Halteren et al. |
| 7,706,561 | B2 | 4/2010 | Wilmink et al. |
| 7,715,583 | B2 | 5/2010 | Van Halteren et al. |
| 7,728,237 | B2 | 6/2010 | Pedersen et al. |
| 7,809,151 | B2 | 10/2010 | Van Halteren et al. |
| 7,822,218 | B2 | 10/2010 | Van Halteren |
| 7,899,203 | B2 | 3/2011 | Van Halteren et al. |
| 7,912,240 | B2 | 3/2011 | Madaffari et al. |
| 7,946,890 | B1 | 5/2011 | Bondo et al. |
| 7,953,241 | B2 | 5/2011 | Jorgensen et al. |
| 7,961,899 | B2 | 6/2011 | Van Halteren et al. |
| 7,970,161 | B2 | 6/2011 | van Halteren |
| 8,098,854 | B2 | 1/2012 | van Halteren et al. |
| 8,101,876 | B2 | 1/2012 | Andreasen et al. |
| 8,103,039 | B2 | 1/2012 | van Halteren et al. |
| 8,160,290 | B2 | 4/2012 | Jorgensen et al. |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman et al. |
| 8,233,652 | B2 | 7/2012 | Jorgensen et al. |
| 8,259,963 | B2 | 9/2012 | Stenberg et al. |
| 8,259,976 | B2 | 9/2012 | van Halteren |
| 8,259,977 | B2 | 9/2012 | Jorgensen et al. |
| 8,280,082 | B2 | 10/2012 | van Halteren et al. |
| 8,284,966 | B2 | 10/2012 | Wilk et al. |
| 8,313,336 | B2 | 11/2012 | Bondo et al. |
| 8,315,422 | B2 | 11/2012 | van Halteren et al. |
| 8,331,595 | B2 | 12/2012 | van Halteren |
| 8,369,552 | B2 | 2/2013 | Engbert et al. |
| 8,379,899 | B2 | 2/2013 | van Halteren et al. |
| 8,509,468 | B2 | 8/2013 | van Halteren et al. |
| 8,526,651 | B2 | 9/2013 | Lafort et al. |
| 8,526,652 | B2 | 9/2013 | Ambrose et al. |
| 2003/0138125 | A1 | 7/2003 | Yu |
| 2008/0159583 | A1 | 7/2008 | Tanaka et al. |
| 2010/0046783 | A1 | 2/2010 | Huang |
| 2011/0182453 | A1 | 7/2011 | van Hal et al. |
| 2011/0189880 | A1 | 8/2011 | Bondo et al. |
| 2011/0255715 | A1* | 10/2011 | Doh ..... H04R 9/10 381/398 |
| 2011/0299708 | A1 | 12/2011 | Bondo et al. |
| 2011/0299712 | A1 | 12/2011 | Bondo et al. |
| 2011/0311069 | A1 | 12/2011 | Ambrose et al. |
| 2012/0014548 | A1 | 1/2012 | van Halteren |
| 2012/0027245 | A1 | 2/2012 | van Halteren et al. |
| 2012/0140966 | A1 | 6/2012 | Mocking et al. |
| 2012/0155683 | A1 | 6/2012 | van Halteren |
| 2012/0155694 | A1 | 6/2012 | Reeuwijk et al. |
| 2012/0255805 | A1 | 10/2012 | van Halteren et al. |
| 2013/0028451 | A1 | 1/2013 | de Roo |
| 2013/0136284 | A1 | 5/2013 | van Hal et al. |
| 2013/0142370 | A1 | 6/2013 | Engbert et al. |
| 2013/0163799 | A1 | 6/2013 | Van Halteren |
| 2013/0195295 | A1 | 8/2013 | van Halteren et al. |

FOREIGN PATENT DOCUMENTS

| | | | |
|---|---|---|---|
| EP | 1194002 | A3 | 6/2003 |
| EP | 2023660 | A1 | 11/2009 |
| GB | 311486 | A | 5/1929 |
| JP | 56132095 | A | 10/1981 |

OTHER PUBLICATIONS

European Search Report, corresponding to co-pending European Patent Application, European Patent Office, Dated Oct. 15, 2015; (4 pages).

* cited by examiner a)

b)

c)

a)

b)

HYBRID RECEIVER MODULE

CROSS-REFERENCE TO RELATED APPLICATION

This application claims the benefit of European Patent Application Ser. No. 14200604.8, filed Dec. 30, 2014, and titled "Hybrid Receiver Module," which is incorporated herein by reference in its entirety.

FIELD OF THE INVENTION

The present invention relates to a hybrid receiver comprising one or more moving armature receivers and a moving coil receiver. In particular, the present invention relates to a hybrid receiver where the moving armature and the moving coil based receivers are at least partly driven by the same magnetic circuit.

BACKGROUND OF THE INVENTION

Different receiver principles have been applied over the years within the hearing aid industry. However, the principles relating to moving armature and moving coil arrangements appear to be the dominant.

It is well-established knowledge that moving armature arrangements are advantageous in the high frequency range, whereas moving coil arrangements are advantageous in the low frequency range.

Over the years attempts have been to combine the technologies upon which the moving armature and a moving coil arrangements are based. So far these attempts have fail in so far as the resulting receivers have been bulky and certainly not suitable for hearing aid related applications where the required space is often not available.

It may thus be seen as an object of embodiments of the present invention to take advantage of the acoustical properties being offered by a combination of at least one moving armature receiver and a moving coil receiver.

It may be seen as a further object of embodiments of the present invention to combine at least one moving armature receiver and a moving coil receiver in a very compact design.

SUMMARY OF INVENTION

The above-mentioned objects are complied with by providing, in a first aspect, a hybrid receiver comprising 1) a moving coil type receiver comprising a first magnetic flux path, and
2) a first moving armature type receiver comprising a second magnetic flux path, wherein the first and second magnetic flux paths, at least partly, share a common magnetic circuit.

Thus, the present invention relates to the hybrid receiver comprising a common magnetic circuit, said common magnetic circuit being adapted to support and/or form part of both the first and second magnetic flux paths. Each of the first and second flux paths may be arranged to guide both essentially static fluxes and dynamic, i.e. time varying, fluxes. The essentially static fluxes may be generated by for example permanent magnets, whereas the dynamic fluxes may be generated by coils when electrical audio signals are applied thereto.

The design of the hybrid receiver of the present invention has several advantages in that the design is very compact due to 1) the moving coil type receiver and the first moving armature type receiver in some embodiments share a diaphragm area and 2) the moving coil type receiver and the first moving armature type receiver share, at least partly, a common magnetic circuit.

At least part of the common magnetic circuit may be adapted to generate an essential static magnetic flux in each of the first and second magnetic flux paths. In the present content essentially static should be understood as essentially constant, i.e. essentially constant magnetic fluxes.

The essential static magnetic flux in each of the first and second magnetic flux paths may be generated by one or more permanent magnets, such as ring-shaped permanent magnets, radially magnetized permanent magnets, rod/bar permanent magnets etc.

In addition to the essential static fluxes, dynamic magnetic fluxes may be added thereto, said dynamic fluxes being generated by at least two coils. These at least two coils may include at least a moveable voice coil of the moving coil receiver and a static coil of the moving armature receiver.

The moving coil type receiver may comprise a first diaphragm and a voice coil attached thereto, the voice coil being adapted to generate a dynamic magnetic flux in order to move the first diaphragm in accordance therewith. The first moving armature type receiver may comprise a second diaphragm and a first static coil, the first static coil being adapted to generate a dynamic magnetic flux in order to move the second diaphragm in accordance therewith. In one embodiment the second diaphragm may be at least partly attached to the first diaphragm. Preferably, the second diaphragm may form an integral part of a centre portion of the first diaphragm.

The first diaphragm may be an injection moulded silicone diaphragm with integrated silicone suspension members. Alternatively, the first diaphragm may be made of a polymer-foil. The second diaphragm may be operatively connected to a moving armature attached to a moving armature suspension element, such as a polymer- or metal foil. The moving armature may be a soft iron material, an iron alloy or a permanent magnet.

In one embodiment the moving armature suspension element may be attached to and thereby suspended across a ring-shaped inner yoke of the common magnetic circuit. Moreover, the common magnetic circuit may further comprise one or more ring-shaped and radially magnetized permanent magnets and/or one or more cylindrically-shaped permanent magnet. The common magnetic circuit may further comprise a centre yoke being positioned along a centre axis of the one or more permanent magnets, and an outer ring-shaped yoke surrounding said one or more permanent magnets. The cylindrically-shaped permanent magnet may be magnetised in a direction being essentially parallel to a longitudinal cylinder axis.

A first air gap may be formed between the inner yoke and the outer ring-shaped yoke, whereas a second air gap may be formed between the centre yoke and the moving armature operatively connected to the second diaphragm.

A second coil adapted to drive the second diaphragm may be arranged at least partly around the centre yoke, i.e. around the end of the centre yoke that is closest to the moving armature. The first and second coils may be operated independently thereby forming a 2-way receiver. Alternatively, they may be operated in parallel.

It is advantageous of the hybrid receiver of the present invention that the moving coil type receiver is adapted to generate sound in a first frequency range, whereas the first moving armature type receiver is adapted to generate sound in a second a frequency range. The first frequency range may at least partly overlap with the second frequency range so that a combination of the two frequency ranges (first and second) may result in a larger overall bandwidth. The first frequency range may be a lower frequency range, whereas the second frequency range may be a higher frequency range. In this way a 2-way hybrid receiver is provided.

The first diaphragm of the moving coil type receiver may be suspended in a high compliance suspension member, wherein the second diaphragm of the first moving armature type receiver may be suspended in a low compliance suspension member.

The hybrid receiver of the present invention may further comprise a second moving armature type receiver comprising a third magnetic flux path, wherein the first, second and third magnetic flux paths, at least partly, share the common magnetic circuit. The second moving armature type receiver may comprise a third diaphragm and a second static coil, the second static coil being adapted to generate a dynamic magnetic flux in order to move the third diaphragm in accordance therewith.

The second and third diaphragms of the respective first and second moving armature receivers may be discrete diaphragms. Such discrete diaphragm may be arranged in a substantial parallel manner. In one embodiment the second and third diaphragms may be arranged on opposite sides of the common magnetic circuit, i.e. the common magnetic circuit may be sandwiched between the second and third diaphragms of the respective first and second moving armature receivers.

The second moving armature type receiver may be adapted to generate sound in a third frequency range. This third frequency range may at least partly overlaps with the first and/or second frequency ranges. In this way a 3-way hybrid receiver is provided.

In a second aspect, the present invention relates to a hybrid receiver comprising a diaphragm having a first and a second portion, wherein the first portion is suspended in a high compliance suspension member, and wherein the second portion is suspended in a low compliance suspension member. The first portion of the diaphragm may be driven by a moving coil attached thereto, whereas the second portion of the diaphragm may be driven by a moving armature attached thereto. The moving coil and the moving armature may be adapted to reproduce sound at different, but still overlapping, frequency ranges. Preferably, the moving coil generates sound at a lower frequency compared to the moving armature.

In a third aspect the present invention relates to a hearing aid comprising a hybrid receiver according to the first or second aspects.

In a fourth and final aspect the present invention relates to a mobile device comprising a hybrid receiver according to the first and second aspects, said mobile device being selected from the group consisting of: personal communication devices, such as mobile phones, tablets, laptops etc., or personal sound amplifiers.

BRIEF DESCRIPTION OF THE DRAWINGS

The present invention will now be explained in further details with reference to the accompanying figures where.

Figure 1:
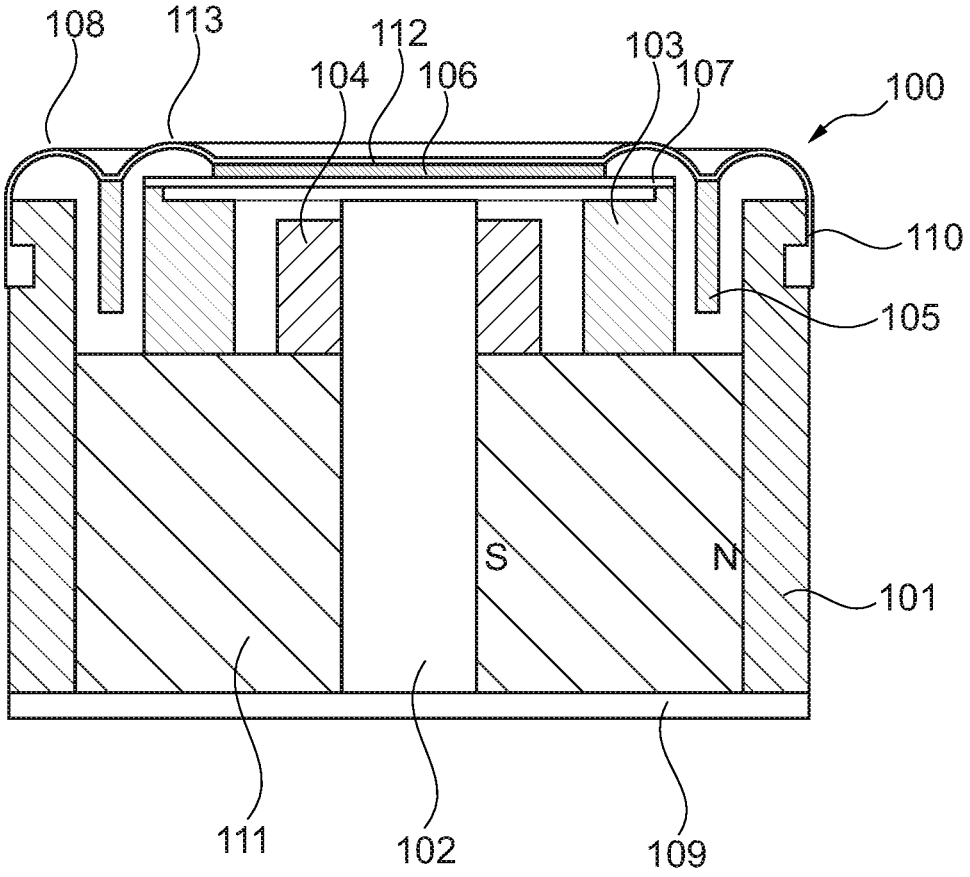
FIG. 1 shows a first embodiment of the hybrid receiver according to the present invention.

While the invention is susceptible to various modifications and alternative forms specific embodiments have been shown by way of examples in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF PREFERRED EMBODIMENTS

In its most general aspect the present invention relates to a hybrid receiver combining the advantages of at least one moving armature arrangement and a moving coil arrangement. In particular, the hybrid receiver of the present invention takes advantage of the high frequency response of the moving armature arrangement in combination with the low frequency response of the moving coil arrangement. As a result the hybrid receiver according to the present invention will provide an improved low- and high frequency performance resulting in a larger bandwidth. Depending on the number of applied moving armature arrangements the hybrid receiver of the present invention may be operated at least as a 2-way or 3-way receiver arrangement.

The hybrid receiver of the present invention forms a compact and robust unit in that the at least one moving armature arrangement and the moving coil arrangement at least partly share the same magnetic circuit.

Figure 2:
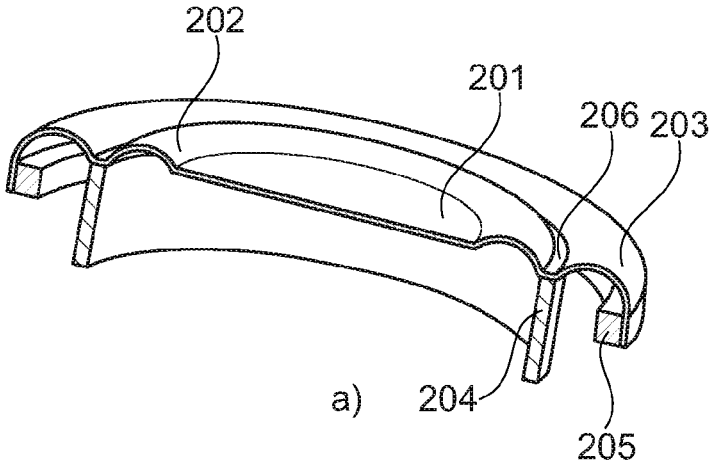
FIG. 2 shows exploded views of the first embodiment of the hybrid receiver according to the present invention.
Figure 2:
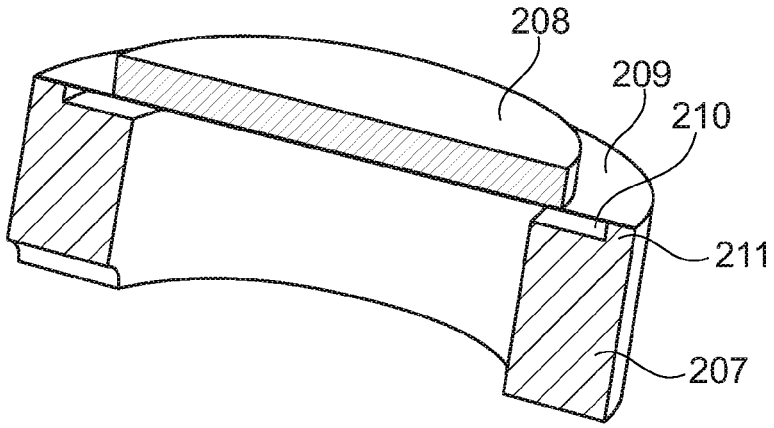
Figure 2:
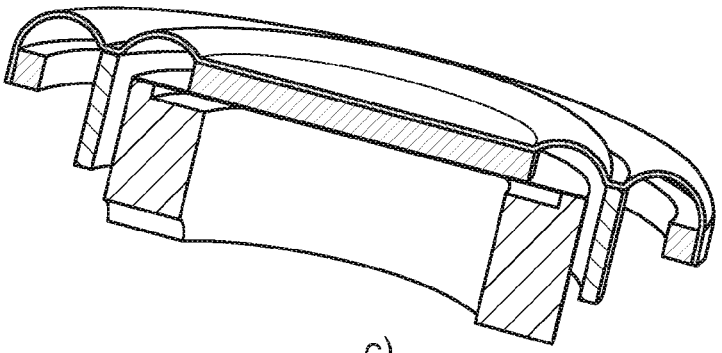

Referring now to FIG. 1 a cross-sectional view of the hybrid receiver 100 is depicted. Generally, the moving armature arrangement is designed around the moving armature 106 which is suspended in the moving armature suspension 107. The moving armature suspension member 107 may, as depicted in FIG. 1, rest on the inner yoke 103, or it may alternatively be secured to an upper region of the voice coil 204, for example between the voice coil 204 and the diaphragm region 206, cf. FIG. 2*a*.

The moving armature suspension 107 can be a polymer foil or a metal foil (steel, aluminium etc.). The thickness of the armature suspension 107 will vary in accordance with the selected material. However, typical thicknesses are in 5-100 μm range. The moving armature 106 can be made of a soft iron, such as an iron-cobalt alloy where the cobalt content equals for example 17%. Alternatively, the moving armature can include a permanent magnet.

The permanent coil 104 drives the moving armature 106 in accordance with an electrical audio signal applied thereto. A wounded cupper wire or a cupper clattered aluminium wire may form the permanent magnet coil 104. The moving armature 106 is secured to the centre portion 112 of the diaphragm. Similarly, the moving coil arrangement is designed around the voice coil 105 which is suspended in suspension members 108, 113. The voice coil 105 may also be formed by a wounded cupper wire or a cupper clattered aluminium wire.

Preferably, the suspension members 108, 113 and the centre portion 112 form an integrated silicone or polymer-foil component. The thickness and the hardness of the suspension members 108, 113 may be 50-70 μm and shore A50-A70, respectively.

The magnetic system driving both the moving armature and the moving coils arrangements comprises a radially magnetized Neodynium (N45) magnet 111, a centre yoke 102, an outer yoke 101 and an inner yoke 103. The yokes 101, 102, 103 are all soft iron yokes. A flux path involving the centre yoke 102, the moving armature 106, the inner yoke 103 and part of the magnet 111 is responsive for driving the moving armature 106 in response to an audio signal being applied to the permanent coil 104. Similarly, a flux path involving the outer yoke 101, the inner yoke 103 and part of the magnet 111 is responsive for driving the moving coil 105 in response to an audio signal being applied thereto.

The permanent coil 104 and the voice coil 105 may be operated completely independently or they may alternatively be operated in parallel set-up.

To facilitate improved low- and high frequency performance the moving coil suspension members 108, 113 are a high compliance, and thereby soft, silicone- or polymer-foil based suspension members, whereas the moving armature suspension member 107 is a low compliance, and thereby stiff, foil-based suspension member.

As furthermore depicted in FIG. 1 a snap-on arrangement 110 is provided in order ease mounting of the suspension arrangement to the outer yoke 101. The snap-on arrangement comprises an integrated and inwardly oriented protrusion that engages with a corresponding recess formed in the outer yoke 101. By using this snap-on arrangement gluing and other complicated fixation techniques can be completely avoided. Moreover, the moving coil suspension member is implemented with negative angles in order to maximize the membrane area. The suspension member elements 108, 113 and the centre portion 112 as well as the snap-on arrangement 110 are preferably manufactured in an integrated one-piece silicone- or polymer-foil based component.

A printed circuit board (PCB) 109 is attached to the lower part of the magnetic circuit. The PCB may house appropriate electronic circuits, such as for example amplifiers and drivers for operating the coils 104 and 105.

Exploded views of the hybrid receiver are shown in FIGS. 2*a-c*. FIG. 2*a* shows the moving coil arrangement involving a diaphragm 201 including suspension members 202, 203. The latter reflects a preferred embodiment of the present invention. The voice coil 204 is secured to the diaphragm 201 in a substantially plane region 206 between the suspension members 202, 203. A fixation element 205 is attached to or integrated with the diaphragm 201 in order to facilitate glue free attachment of the diaphragm 201 to an associated outer yoke of the magnetic circuit.

As previously mentioned the diaphragm 201 including suspension members 202, 203 and optionally the fixation element 205, may be manufactured as an injection moulded integrated silicone or polymer-foil component, i.e. a one piece component. In case of a silicone component the process involved for manufacturing at least the suspension members 202, 203 may for example involve liquid silicone resin (LSR) moulding.

Referring now to FIG. 2*b* the main components of the moving armature arrangement is depicted. As seen the moving armature 208 is attached to its suspension member 209 which is secured to the inner yoke 207. In order to allow the suspension member 209 to bend downward, and thereby moving the armature 208 in a downward direction, a free space region 210 is provided below the suspension member 209. The suspension member 209 is thus only attached to an outer region 211 of the inner yoke 207.

In FIG. 2*c* the moving coil (FIG. 2*a*) and the moving armature (FIG. 2*b*) arrangements have been assembled by attaching the moving armature 208 to the plane centre portion of the diaphragm 201. The attachment of the moving armature 208 to the centre portion of the diaphragm 201 may suitable involve gluing techniques.

Figure 3:
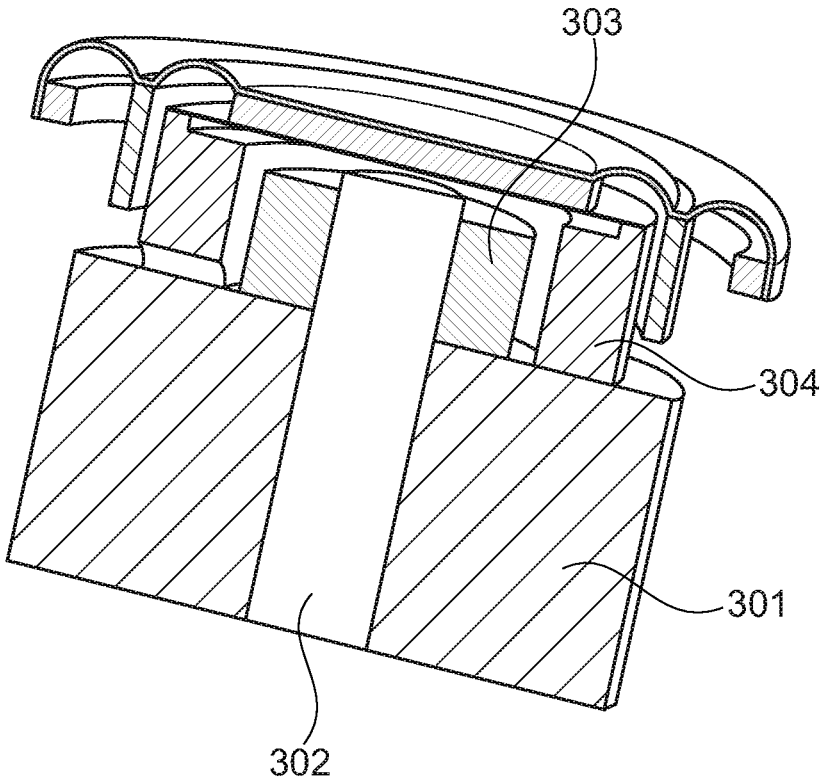
FIG. 3 shows the magnetic circuit and the moving parts of a first embodiment of the hybrid receiver according to the present invention.

In FIG. 3 the combined moving coil and moving armature arrangements (FIG. 2*c*) have been assembled with a part of the magnetic circuit including the radially magnetized magnet 301, the centre yoke 302 and the permanent coil 303. As seen the inner yoke 304 is attached to the centre magnet 301 whereby the moving coil and the moving armature arrangements becomes properly secured to the magnetic circuit.

Figure 4:
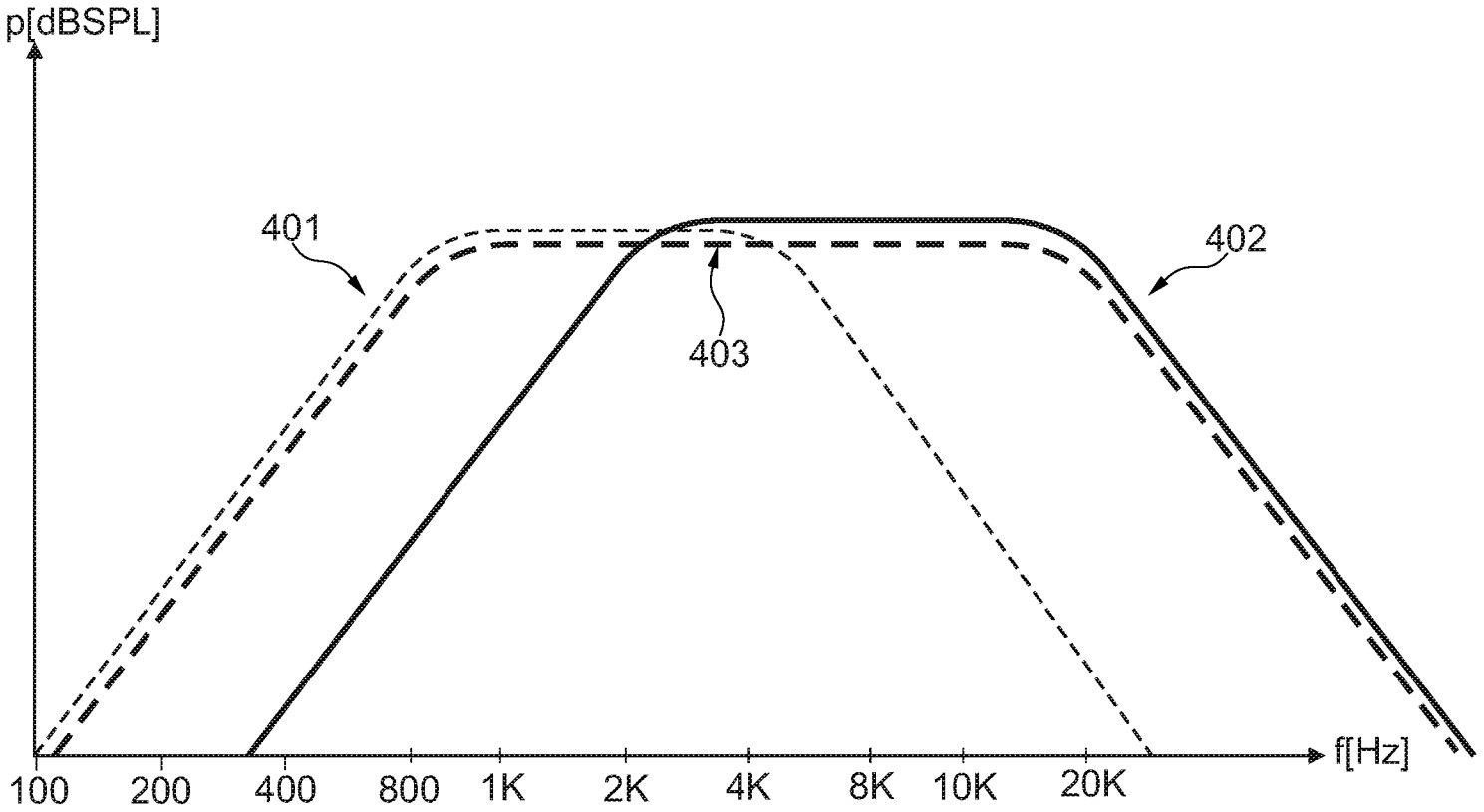
FIG. 4 shows a frequency response of a 2-way hybrid receiver according to the present invention.

In FIG. 4 illustrative sound pressure levels (SPL) are depicted for typical moving coil and moving armature arrangements. As seen, the moving coil response 401 is dominant in a low frequency range, whereas the moving armature response 402 is dominant in a high frequency range. The hybrid receiver of the present invention aims at combining the two frequency response curves 401, 402 of FIG. 4 in order to arrive at a resulting response curve 403 having a significantly broader bandwidth.

Figure 5:
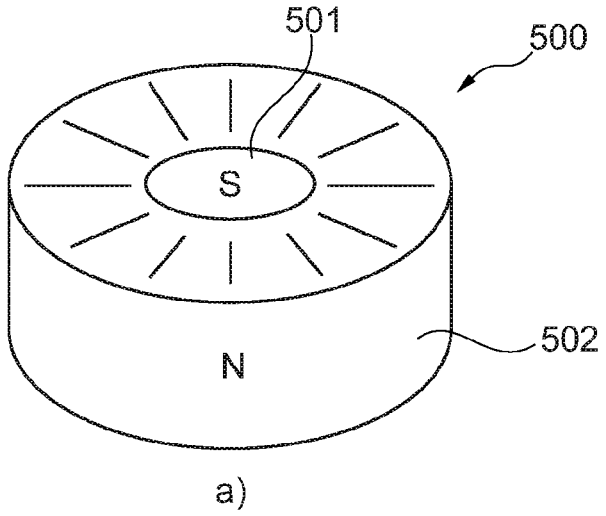
FIG. 5 shows a centre magnet of a first embodiment of the hybrid receiver according to the present invention.
Figure 5:
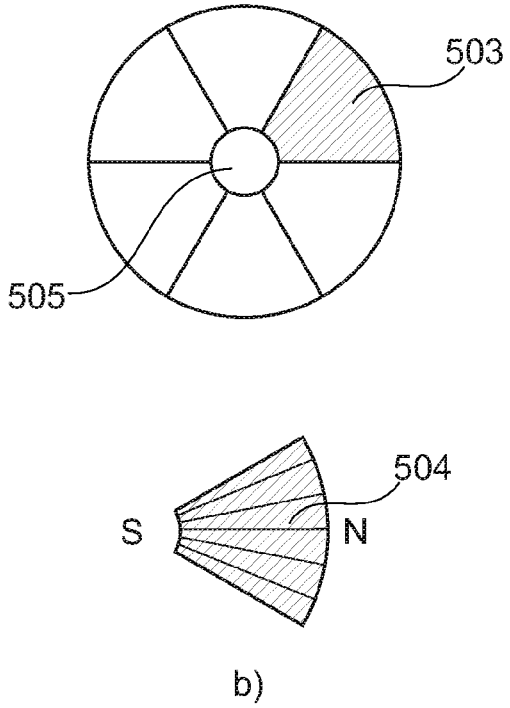

In FIG. 5 the radially magnetized Neodynium (N45) centre magnet 500 is depicted. As seen in FIG. 5*a* the inner rim 501 of the magnet forms the S-pole, whereas the outer rim 502 of the magnet forms the N-pole. The centre magnet 500 may be implemented in various ways, such as being formed by a plurality of segments 503 being assembled, cf. FIG. 5*b*. The number of applied segments may be chosen in respect of the dimensions of the centre magnet. Moreover, each segment can be constituted by a number of even smaller segments 504 as depicted in FIG. 5*b*.

Typically, the diameter of the centre magnet 500 is in the range of around 5 mm. The diameter of the through going hole 501, 505 is typically around 1 mm.

Figure 6:
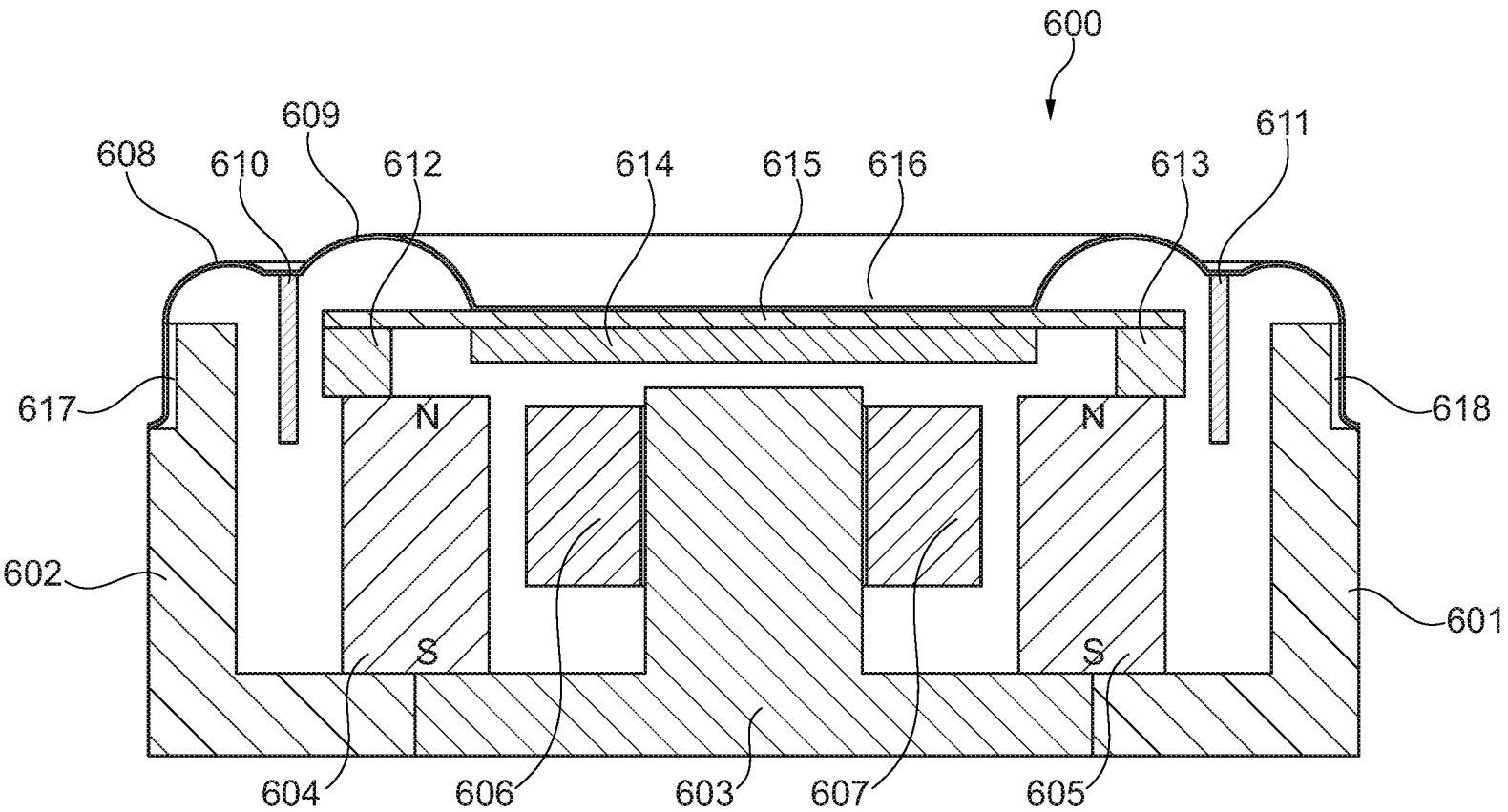
FIG. 6 shows a second embodiment of the hybrid receiver according to the present invention.

FIG. 6 shows a cross-sectional view of another embodiment of the hybrid receiver 600 of the present invention. The hybrid receiver shown in FIG. 6 comprises a moving coil receiver and a moving armature receiver. The moving coil receiver is adapted to cover a low frequency range, whereas the moving armature receiver is adapted to cover a high frequency range. Compared to the embodiment shown in FIG. 1 the magnetisation of the permanent magnet 604, 605 in FIG. 6 is different in that the direction of magnetisation has been rotated 90 degrees. As seen in FIG. 6 the permanent magnet 604, 605 is magnetised in a direction being essentially parallel to the direction of movements of the moving armature and the moving coil diaphragms.

Referring now to FIG. 6 the hybrid receiver comprises a centre pole piece 603 and two outer pole pieces 601, 602. A static coil 606, 607 is arranged around the centre pole piece 603. The static coil 606, 607 is adapted to drive the moving armature 614 when an electrical audio signal is applied thereto. The static coil 606, 607 is suspended in the low compliance moving armature suspension element 615 which rests on the pole pieces 612, 613.

The moving coil diaphragm comprises a centre portion 616 being suspended in a high compliance suspension arrangement comprising an inner suspension member 609 and an outer suspension member 608. A voice coil 610, 611 is secured to the diaphragm in a region between the suspension members 608 and 609. The moving coil diaphragm is secured to the outer pole piece 601, 602 in an indentation 617, 618 formed therein.

In terms of applied soft iron materials, permanent magnets, coil materials, air gap distances, frequency response curves etc. the embodiment shown in FIG. 6 may be similar to the embodiment depicted in FIG. 1. Thus, the moving coil diaphragm may be an injection moulded silicone diaphragm with integrated silicone suspension members 608, 609. Alternatively, the moving coil diaphragm may be made of a polymer-foil. The moving armature diaphragm may be operatively connected to the moving armature 614 attached to a moving armature suspension element 615, such as a polymer- or metal foil. The moving armature 614 may be a soft iron material, an iron alloy or a permanent magnet.

Figure 7:
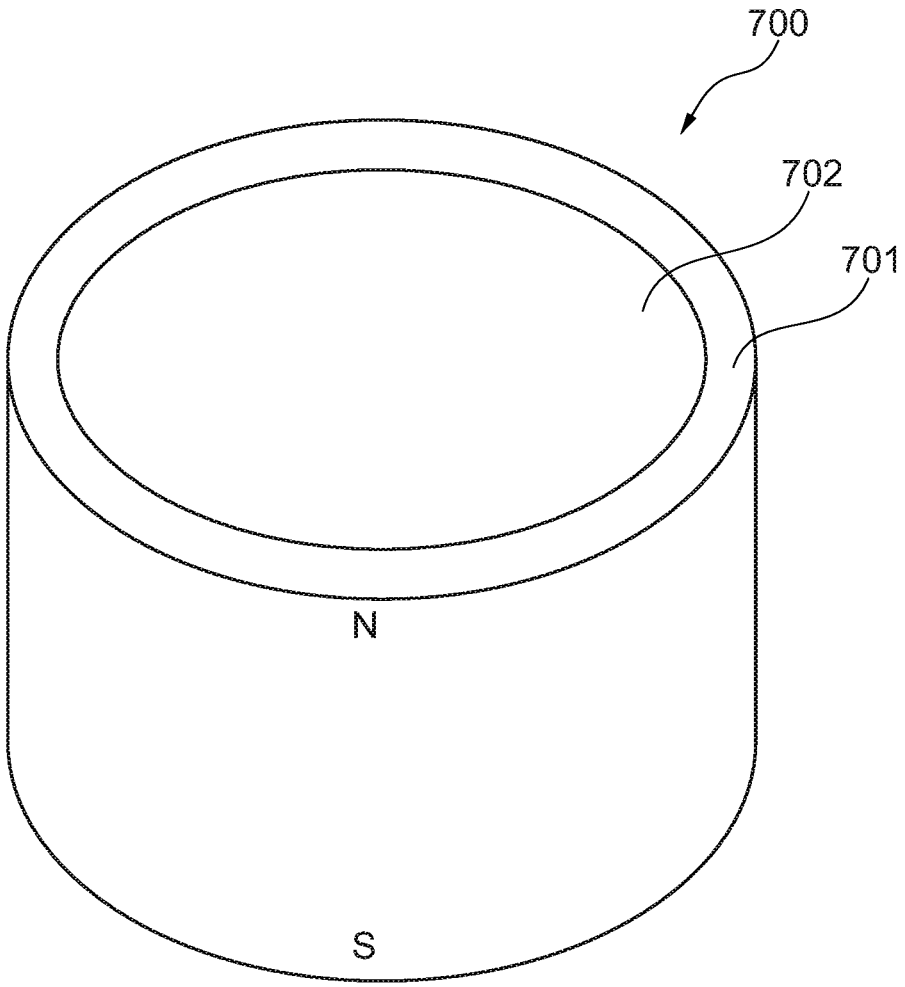
FIG. 7 shows a cylindrically shaped permanent magnet of a first embodiment of the hybrid receiver according to the present invention.

Referring now to FIG. 7 the permanent magnet 700 of the hybrid receiver of FIG. 6 is depicted. As seen in FIG. 7 the permanent magnet 700 is shaped as a cylinder having an inner hole 702. The magnetic material 701 is magnetized Neodynium (N45) having its south pole (S) at the bottom and its north pole (N) at the top. It should be noted however that the north and south poles may be reversed.

FIGS. 8-11 depict schematic illustrations of various alternative embodiments of the present invention.

Figure 8:
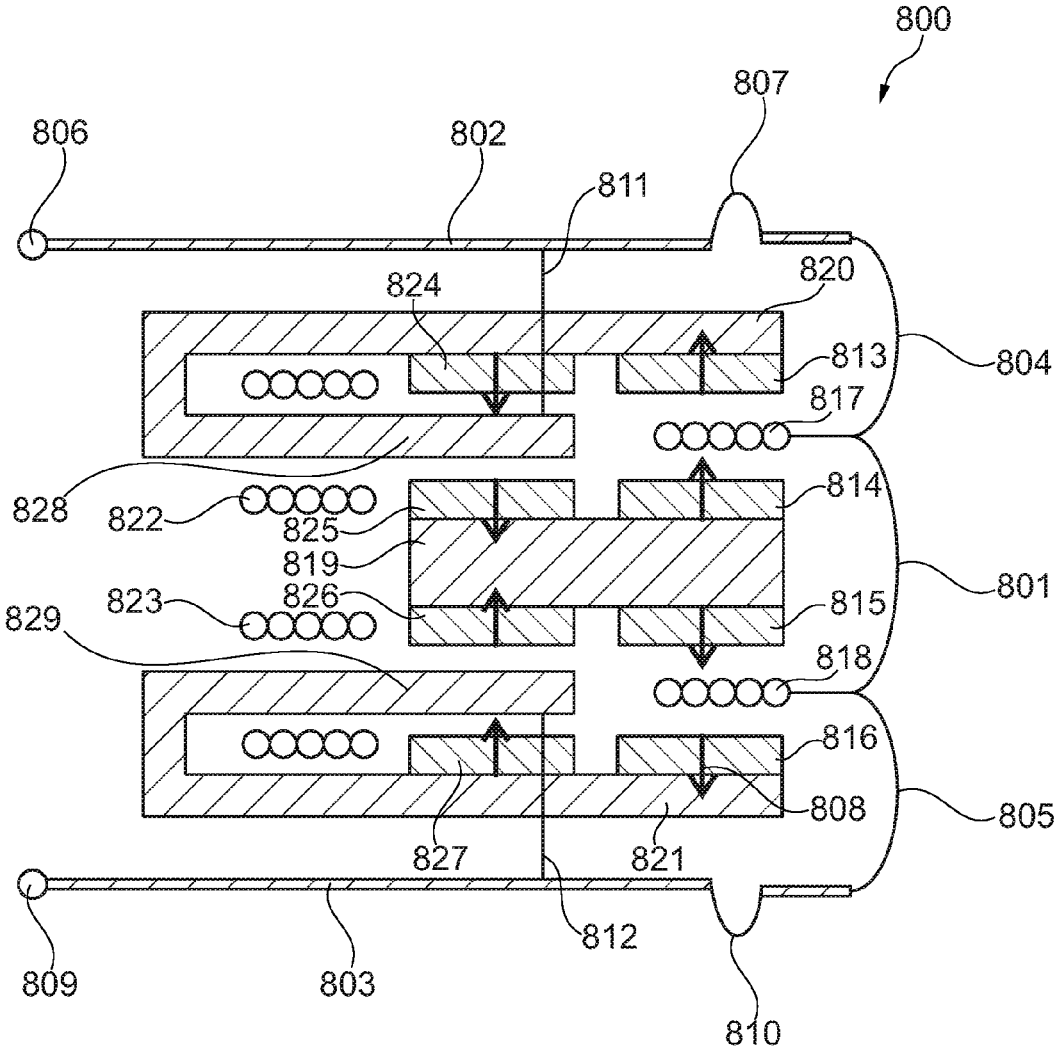
FIG. 8 shows a third embodiment of the hybrid receiver according to the present invention.

Referring now to FIG. 8 a hybrid receiver 800 comprising two balanced armature receivers and a moving coil receiver is depicted. The moving coil receiver comprises a diaphragm 801 being suspended in high compliance suspension members 804, 805. A voice coil 817, 818 is attached to the moving coil diaphragm. The voice coil 817, 818 is positioned in the air gaps being defined by the permanent magnets 813-816 being magnetised as indicated by the associated arrows 808.

The first moving armature receiver comprises a diaphragm 802 being hinged at point 806 and suspended via a low compliance suspension member 807. The diaphragm 802 is driven by the mechanical connection 811 which connection is secured to armature 828. Permanent magnets 824, 825 define an air gap into which air gap the armature 828 extend. A static coil 822 is provided around the armature 828 in order move the armature 828 in accordance with a generated dynamic magnetic flux. The dynamic magnetic flux is generated in response to an electrical audio signal being applied to the static coil 822.

Similarly, the second moving armature receiver comprises a diaphragm 803 being hinged at point 809 and suspended via a low compliance suspension member 810. The diaphragm 803 is driven by the mechanical connection 812 which connection is secured to armature 829. Permanent magnets 826, 827 define an air gap into which air gap the armature 829 extend. A static coil 823 is provided around the armature 829 in order move the armature 829 in accordance with a generated dynamic magnetic flux. Again, the dynamic magnetic flux is generated in response to an electrical audio signal being applied to the static coil 823.

The centre pole piece 819 and the outer pole pieces 820, 821 closes the magnetic flux return paths of both the moving coil receiver and the moving armature receivers.

The moving coil receiver and the moving armature receivers may be operated independently. Thus, the hybrid receiver of FIG. 8 may be operated as a 3-way receiver.

Typically, the moving coil receiver will cover the lowest frequency range, whereas the two moving armature receivers cover the higher frequency ranges. In case the two moving armature receiver cover the same high frequency range the hybrid receiver becomes a 2-way receiver. In case the two moving armature receivers cover different high frequency ranges the hybrid receiver becomes a 3-way receiver. The two moving armature receivers may be configured to cover different frequency ranges by applying different electrical audio signals to the respective static coils 822, 823, or by providing structural differences to the two moving armature receivers.

Figure 9:
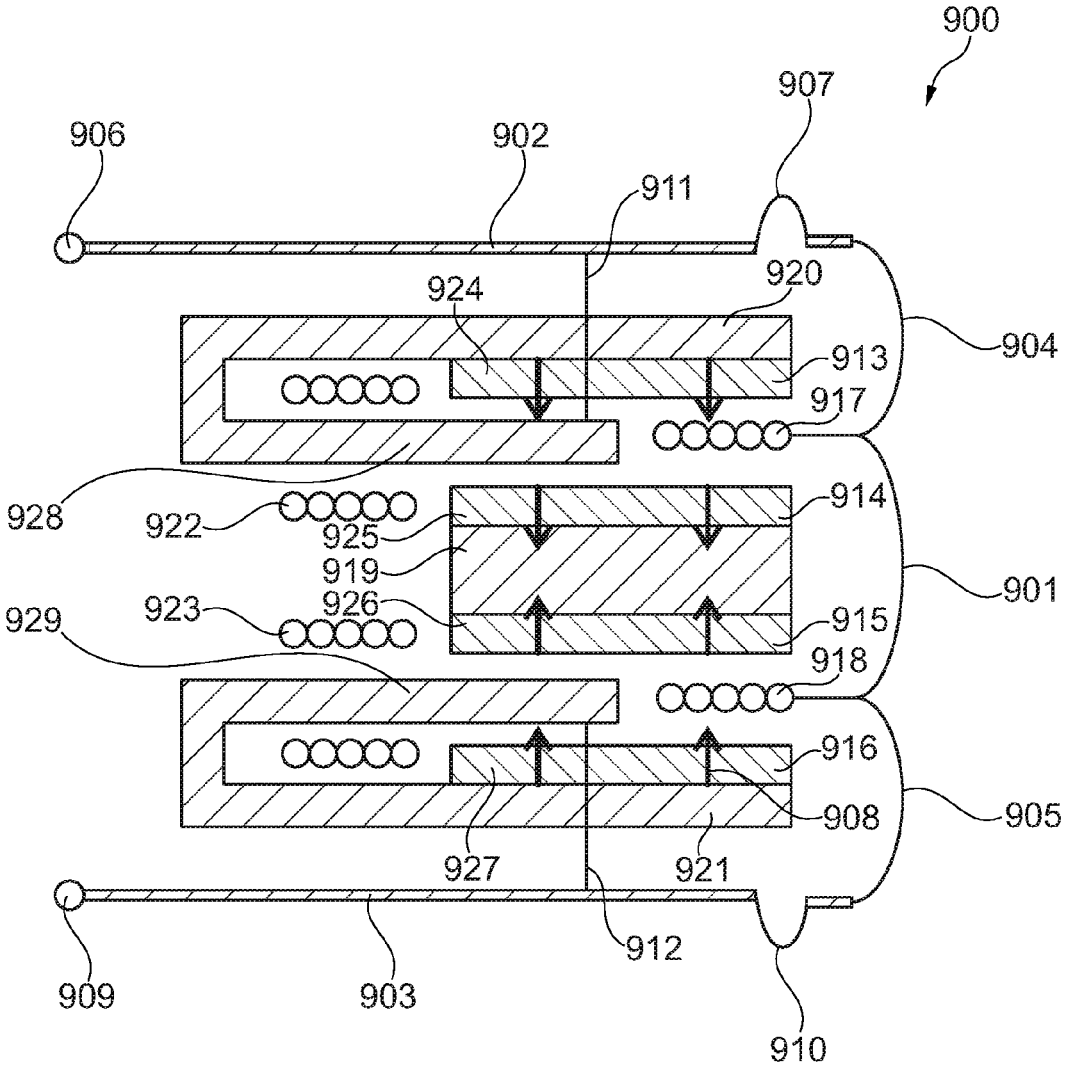
FIG. 9 shows a fourth embodiment of the hybrid receiver according to the present invention.

FIG. 9 depicts another hybrid receiver 900 embodiment. The embodiment shown in FIG. 9 is very similar to the embodiment of FIG. 8 in that the difference between the two embodiments only relates to a simplification of the arrangement of the permanent magnets. In the embodiment depicted in FIG. 9 the permanents magnets 913, 924; 914, 925; 915, 926 and 916, 927 have been combined. Thus, the total number of permanents magnets applied has been reduced from 8 magnets (in FIG. 8) to 4 magnets (in FIG. 9). The direction of magnetisation of the permanent magnets is illustrated by the arrow 908.

Otherwise, the hybrid receiver 900 depicted in FIG. 9 comprises two balanced armature receivers and a moving coil receiver is depicted. The moving coil receiver comprises a diaphragm 901 being suspended in high compliance suspension members 904, 905. A voice coil 917, 918 is attached to the moving coil diaphragm. The voice coil 917, 918 is positioned in the air gaps being defined by the permanent magnets portions 913-916 being magnetised as indicated by the associated arrows 908.

The first moving armature receiver comprises a diaphragm 902 being hinged at point 906 and suspended via a low compliance suspension member 907. The diaphragm 902 is driven by the mechanical connection 911 which connection is secured to armature 928. Permanent magnets portions 924, 925 define an air gap into which air gap the armature 928 extend. A static coil 922 is provided around the armature 928 in order move the armature 928 in accordance with a generated dynamic magnetic flux. The dynamic magnetic flux is generated in response to an electrical audio signal being applied to the static coil 922.

Similarly, the second moving armature receiver comprises a diaphragm 903 being hinged at point 909 and suspended via a low compliance suspension member 910. The diaphragm 903 is driven by the mechanical connection 912 which connection is secured to armature 929. Permanent magnets portion 926, 927 define an air gap into which air gap the armature 929 extend. A static coil 923 is provided around the armature 929 in order move the armature 929 in accordance with a generated dynamic magnetic flux. The dynamic magnetic flux is generated in response to an electrical audio signal being applied to the static coil 923.

The centre pole piece 919 and the outer pole pieces 920, 921 closes the magnetic flux return paths of both the moving coil receiver and the moving armature receivers.

The moving coil receiver and the moving armature receivers may be operated independently. Thus, the hybrid receiver of FIG. 9 may be operated as a 3-way receiver.

Typically, the moving coil receiver will cover the lowest frequency range, whereas the two moving armature receivers cover the higher frequency ranges. In case the two moving armature receiver cover the same high frequency range the hybrid receiver becomes a 2-way receiver. In case the two moving armature receivers cover different high frequency ranges the hybrid receiver becomes a 3-way receiver. The two moving armature receivers may be configured to cover different frequency ranges by applying different electrical audio signals to the respective static coils 922, 923, or by providing structural differences to the two moving armature receivers.

Figure 10:
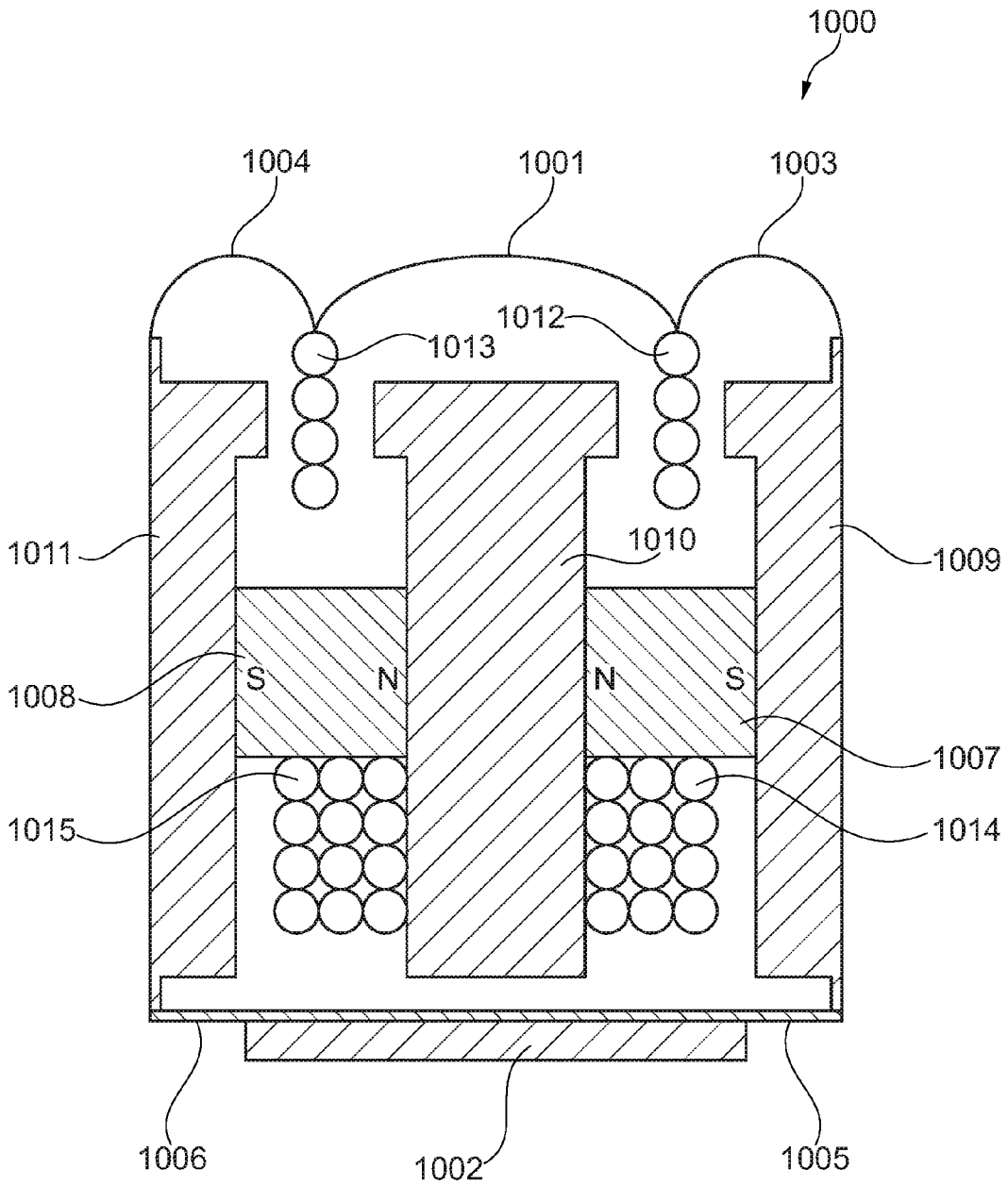
FIG. 10 shows a fifth embodiment of the hybrid receiver according to the present invention.

FIG. 10 depicts a hybrid receiver 1000 having a moving coil receiver and a moving armature receiver. As seen in FIG. 10 the moving coil and moving armature receivers are positioned at opposite ends of the of the hybrid receiver. Sound is transported between the two receivers via a tube shaped centre pole piece 1010 so that the hybrid receiver has it sound outlet at one side. Moreover, the tube may be tuned to form an acoustical filter, such as a low-pass filter.

In FIG. 10 the moving coil diaphragm 1001 is suspended in a set of high compliance suspension members 1003, 1004 which is secured to the outer pole pieces 1009, 1011, respectively. A voice coil 1012, 1013 is secured to the moving coil diaphragm. Two permanent magnets 1007, 1008 generate a static flux via the centre pole piece 1010 and the outer pole pieces 1009, 1011. In the lower part of FIG. 10 a moving armature 1002 is suspended in low compliance suspension members 1005, 1006 which are secured to the outer pole pieces 1009, 1011, respectively. A static coil 1014, 1015 is adapted to generate a dynamic magnetic flux in response to an electrical audio signal being provided thereto.

In the hybrid receiver shown in FIG. 10 the moving coil receiver will cover the lowest frequency range, whereas the moving armature receiver will cover the high frequency range. Thus, the hybrid receiver depicted in FIG. 10 will be operated as a 2-way receiver.

Figure 11:
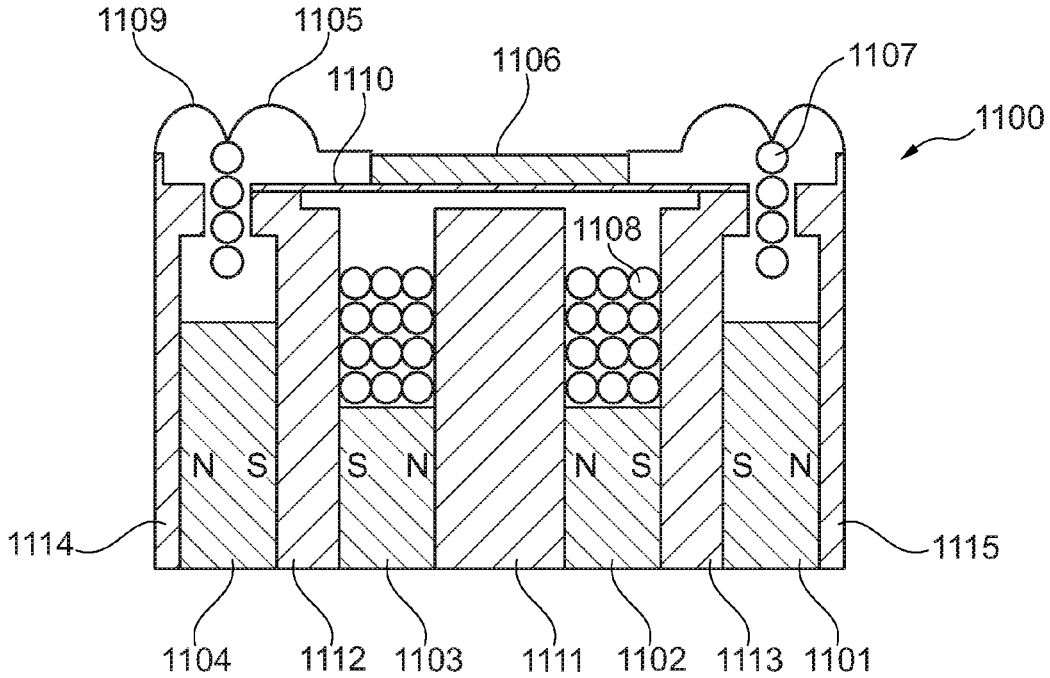
FIG. 11 shows a sixth and seventh embodiments of the hybrid receiver according to the present invention.
Figure 11:
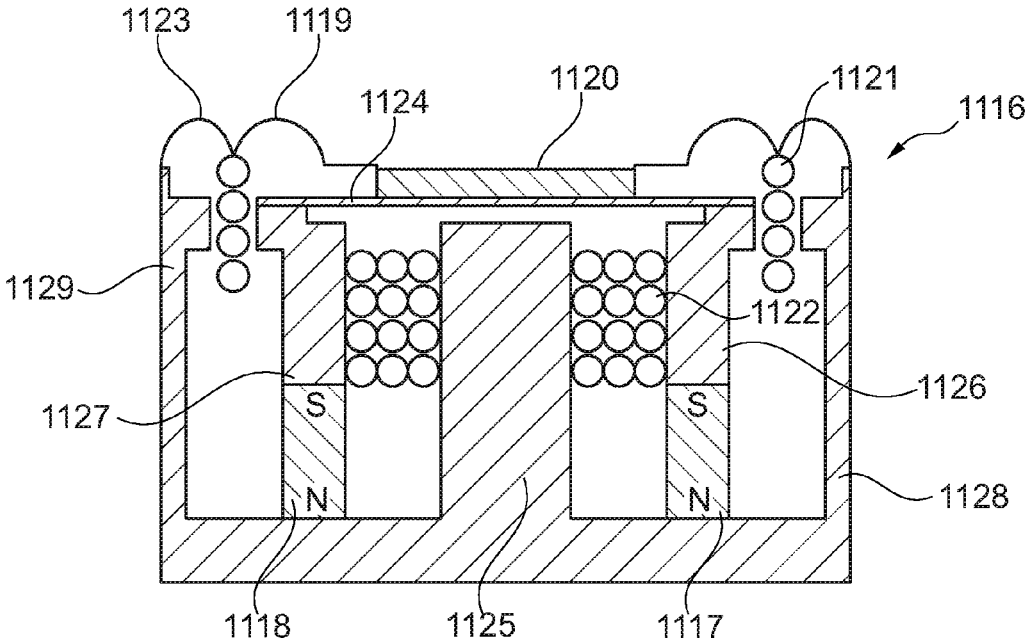

Turning now to FIG. 11 variants 1100, 1116 of the hybrid receiver shown in FIGS. 1-3 and 6 are schematically depicted. The hybrid receiver of FIG. 11*a* comprises a combined moving coil/moving armature diaphragm. The moving armature 1106 is suspended in the low compliance suspension member 1110, whereas a high compliance suspension member 1109 suspends the moving coil diaphragm 1105. A moving coil 1107 is secured to the moving coil diaphragm. A total of 4 permanent magnets 1101-1104 generate the static flux in the hybrid receiver 1100. A static coil 1108 generates the moving armature dynamic magnetic flux, and a centre pole piece 1111, two inner pole pieces 1112, 1113 and two outer pole pieces 1114, 1115 guides, in combination, the dynamic and static fluxes to the moving coil air gap and the moving armature air gap. The hybrid receiver depicted in FIG. 11*a* may be operated as a 2-way receiver.

The hybrid receiver of FIG. 11*b* is a simplification of the design depicted in FIG. 11*a* in that the number of permanents magnets has been reduced from 4 magnets to 2 magnets. Referring now to FIG. 11*b* the hybrid receiver 1116 comprises a combined moving coil/moving armature diaphragm. The moving armature 1120 is suspended in the low compliance suspension member 1124, whereas a high compliance suspension member 1123 suspends the moving coil diaphragm 1119. A moving coil 1121 is secured to the moving coil diaphragm. Two permanent magnets 1117, 1118 generate the static flux in the hybrid receiver 1116. A static coil 1122 generates the moving armature dynamic magnetic flux, and a centre pole piece 1125, two inner pole pieces 1126, 1127 and two outer pole pieces 1128, 1129 guides, in combination, the dynamic and static fluxes to the moving coil air gap and the moving armature air gap. The hybrid receiver depicted in FIG. 11*b* may be operated as a 2-way receiver.

In terms of applied soft iron materials, permanent magnets, coil materials, air gap distances, frequency response curves etc. the embodiments shown in FIGS. 8-11 may be similar to the embodiment depicted in FIG. 1. Thus, in the embodiments of FIGS. 6, 10 and 11 the moving coil diaphragm may be an injection moulded silicone diaphragm with integrated silicone suspension members. Alternatively, the moving coil diaphragm may be made of a polymer-foil. The moving armature diaphragm may be operatively connected to the moving armature attached to a moving armature suspension element, such as a polymer- or metal foil. The moving armature may be a soft iron material, an iron alloy or a permanent magnet. As to the embodiments depicted in FIGS. 8 and 9 the moving armature diaphragms 802, 803, 902, 903 are suspended in respective suspension members 807, 810, 907, 910 which may be silicone suspension members.

The invention claimed is:

1. A hybrid receiver comprising 1) a moving coil type receiver comprising a first magnetic flux path, and 2) a first moving armature type receiver comprising a second magnetic flux path, wherein the first and second magnetic flux paths, at least partly, share a common magnetic circuit, and wherein at least part of the common magnetic circuit is adapted to generate an essential static magnetic flux in each of the first and second magnetic flux paths.

2. A hybrid receiver according to claim 1, wherein the moving coil type receiver comprises a first diaphragm and a voice coil attached thereto, the voice coil being adapted to generate a dynamic magnetic flux in order to move the first diaphragm in accordance therewith.

3. A hybrid receiver according to claim 2, wherein the first moving armature type receiver comprises a second diaphragm and a first static coil, the first static coil being adapted to generate a dynamic magnetic flux in order to move the second diaphragm in accordance therewith.

4. A hybrid receiver according to claim 3, wherein the second diaphragm is at least partly attached to the first diaphragm.

5. A hybrid receiver according to claim 4, wherein the second diaphragm forms an integral part of a centre portion of the first diaphragm.

6. A hybrid receiver according to claim 2, wherein the first diaphragm is suspended in a high compliance suspension member, and wherein the second diaphragm is suspended in a low compliance suspension member.

7. A hybrid receiver according to claim 1, where the moving coil type first receiver is adapted to generate sound in a first frequency range, whereas the first moving armature type receiver is adapted to generate sound in a second frequency range.

8. A hybrid receiver according to claim 7, where the first frequency range at least partly overlaps with the second frequency range.

9. A hybrid receiver according to claim 7, where the first frequency range comprises lower frequencies than the second frequency range.

10. A hybrid receiver according to claim 1, further comprising a second moving armature type receiver comprising a third magnetic flux path.

11. A hybrid receiver according to claim 10, wherein the first, second and third magnetic flux paths, at least partly, share the common magnetic circuit.

12. A hybrid receiver according to claim 10, wherein the second moving armature type receiver comprises a third diaphragm and a second static coil, the second static coil being adapted to generate a dynamic magnetic flux in order to move the third diaphragm in accordance therewith.

13. A hybrid receiver according to claim 12, wherein the second and third diaphragms are arranged in a substantial parallel manner.

14. A hybrid receiver according to claim 12, wherein the second and third diaphragms are arranged on opposite sides of the common magnet circuit.

15. A hybrid receiver according to claim 10, wherein the second moving armature type receiver is adapted to generate sound in a third frequency range.

16. A hybrid receiver according to claim 15, wherein the third frequency range at least partly overlaps with the first and/or second frequency ranges.

17. A hybrid receiver comprising a diaphragm having a first and a second portion, wherein the first portion is suspended in a high compliance suspension member, and wherein the second portion is suspended in a low compliance suspension member, and wherein the first portion of the diaphragm forms part of a moving coil type receiver, and wherein the second portion of the diaphragm form part of a moving armature type receiver that shares, at least partly, a common magnetic circuit such that at least part of the common magnetic circuit is adapted to generate an essential static magnetic flux in the common magnetic circuit.

18. A hearing device comprising a hybrid receiver according to claim 1, said hearing device comprising a hearing aid being selected from the group consisting of: behind-the-ear, in-the-ear, in-the-canal, invisible-in-canal and completely-in-canal.

19. A mobile device comprising a hybrid receiver according to claim 1, said mobile device being selected from the group consisting of: personal communication devices, mobile phones, tablets, laptops, or personal sound amplifiers.

20. A hybrid receiver according to claim 1, wherein the common magnetic circuit comprises one or more permanent magnets for generating the essential static magnetic flux.

21. A hybrid receiver according to claim 20, wherein the one or more permanent magnets comprise ring-shaped permanent magnets, radially magnetized permanent magnets, and/or rod/bar permanent magnets.

* * * * *